US010703130B2

(12) United States Patent
Aoki et al.

(10) Patent No.: US 10,703,130 B2
(45) Date of Patent: Jul. 7, 2020

(54) METHOD OF MANUFACTURING DECORATIVE OBJECT, METHOD OF REPAIRING DECORATIVE OBJECT, TRANSFER MEMBER, AND DECORATING KIT

(71) Applicant: 3M INNOVATIVE PROPERTIES COMPANY, St. Paul, MN (US)

(72) Inventors: Toru Aoki, Kanagawa Prefecture (JP); Akira Yoda, Tokyo (JP); Yoko Nakamura, Tokyo (JP)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 204 days.

(21) Appl. No.: 15/765,363

(22) PCT Filed: Sep. 23, 2016

(86) PCT No.: PCT/US2016/053239
§ 371 (c)(1),
(2) Date: Apr. 2, 2018

(87) PCT Pub. No.: WO2017/062191
PCT Pub. Date: Apr. 13, 2017

(65) Prior Publication Data

US 2018/0281507 A1 Oct. 4, 2018

(30) Foreign Application Priority Data

Oct. 9, 2015 (JP) ..... 2015-201098

(51) Int. Cl.
*B44C 1/17* (2006.01)

(52) U.S. Cl.
CPC ..... *B44C 1/1712* (2013.01)

(58) Field of Classification Search
CPC ..... B44C 1/1712; B44C 1/00; B44C 3/02; B44C 5/04; B44C 3/005; B44C 1/005;
(Continued)

(56) References Cited

U.S. PATENT DOCUMENTS 6,964,722 B2 * 11/2005 Taylor ..... B41M 5/0082 101/34
8,187,695 B2 * 5/2012 Iizuka ..... B32B 27/10 428/195.1

FOREIGN PATENT DOCUMENTS

CN 1050849 4/1991
CN 203651231 6/2014
(Continued)

OTHER PUBLICATIONS

International Search Report for PCT International Application No. PCT/US2016/053239, dated Dec. 29, 2016, 4 pages.

*Primary Examiner* — Michael N Orlando
*Assistant Examiner* — Abhishek A Patwardhan
(74) *Attorney, Agent, or Firm* — Aleksander Medved

(57) ABSTRACT

A method for manufacturing a decorative object, which enables manufacturing of a decorative object, on which a random concavo-convex structure is formed, such as non-glossy finish, with a uniform product appearance, while maintaining operating efficiency is described. The method for manufacturing a decorative object includes the steps of coating a concavo-convex surface having a concavo-convex structure with a coating solution including a resin component, transferring the concavo-convex structure to a transfer surface to form a resin layer having the transfer surface, and to obtain a transfer member comprising the resin layer, and decorating a surface for decoration by pressing the transfer surface of the transfer member against the surface for decoration including a thermoplastic resin while heating.

4 Claims, 2 Drawing Sheets

(58) Field of Classification Search
CPC .... B44C 1/16; B44C 3/00; B44C 1/24; B44C 1/1716; B44C 1/172; B44C 1/1729; B44C 1/18; B44C 1/20; B44C 3/04; B44C 3/042; B44C 3/08; B44C 3/085; B44C 3/12; B44C 3/123; B44C 3/126; B44C 5/0005; B44C 5/02; B44C 5/0469; B44D 5/00
USPC ..... 156/94
See application file for complete search history.

(56) References Cited

FOREIGN PATENT DOCUMENTS

| | | | | |
|---|---|---|---|---|
| CN | 203651231 | U | * | 6/2014 |
| JP | 03007341 | A2 | | 1/1991 |
| JP | 05147185 | A2 | | 6/1993 |
| JP | 2001276725 | | | 10/2001 |
| JP | 2004124020 | | | 4/2004 |
| JP | 2006198911 | | | 8/2006 |
| JP | 2006231136 | | | 9/2006 |
| JP | 2011000865 | | | 1/2011 |
| JP | 2011000865 | A | * | 1/2011 |
| JP | WO2013133375 | A1 | * | 7/2015 |
| WO | WO 2004/106082 | | | 12/2004 |
| WO | WO 2013/133375 | | | 9/2013 |

* cited by examiner

METHOD OF MANUFACTURING DECORATIVE OBJECT, METHOD OF REPAIRING DECORATIVE OBJECT, TRANSFER MEMBER, AND DECORATING KIT

CROSS REFERENCE TO RELATED APPLICATIONS

This application is a national stage filing under 35 U.S.C. 371 of PCT/US2016/053239, filed Sep. 23, 2016, which claims priority to JP Application No. 2015-201098 filed Oct. 9, 2015, the disclosures of which are incorporated by reference in their entireties herein.

BACKGROUND

The present disclosure relates to a method of manufacturing a decorative object. Another aspect of the present relates to a method of repairing a decorative object. Further aspects relate to a transfer member and a decorating kit.

Conventionally, a coating such as a coating layer has been provided upon a product surface in various fields, such as automobiles and electrical home appliances, and improvement of a product appearance by decorating such a coated surface has been studied.

One aspect of such decoration includes non-glossy processing for producing a luxurious feel and suppressing reflection of sunlight. Non-glossy processing is usually achieved by forming fine convexities and concavities on a product surface. Non-glossy processing is usually performed by coating a product surface with a non-glossy paint. For example, Japanese Unexamined Patent Application Publication No. 2004-124020A describes non-glossy processing performed by coating a product surface with a non-glossy paint comprising a non-glossy material including a particulate resin. Japanese Unexamined Patent Application Publication No. 2006-231136A describes a method in which ice particle blasting is performed on a surface of a clear coat layer.

SUMMARY

A decorating method such as non-glossy processing, in which a random concavo-convex structure is formed on a product surface, may not be able to provide a uniform product appearance due to a variation of the concavo-convex structure formed, caused by a minute difference in a processing condition. In some decorating methods, the operating efficiency may be compromised in some cases, including a case in which a part of a product is decorated while the other part of the product must be covered with a protective material.

In addition, when a part of the decorated product surface is repaired, the appearance may be impaired because the appearance of the repaired part fails to match that of the unrepaired part, or the location of the repair may become conspicuous because a processing at the interface between the repair part and the unrepaired part fails to provide uniformity.

In one aspect, the present invention provides a method for manufacturing a decorative object, which enables manufacturing a decorative object, on which a random concavo-convex structure is formed, such as non-glossy finish, with a uniform product appearance, while the operating efficiency is excellent. In another aspect, the present invention provides a method of repairing a decorative object, which can achieve a uniform appearance across a repaired part and an unrepaired part and an excellent product appearance while preventing the interface between a repaired part and an unrepaired part becoming noticeable. In another aspect, the present invention provides a transfer member and a decorating kit, which can be used in the method of manufacturing and the method for repairing described above.

In one embodiment, a method of manufacturing a decorative object includes the steps of coating a concavo-convex surface having a concavo-convex structure with a coating solution including a resin component, transferring the concavo-convex structure to a transfer surface to form a resin layer having the transfer surface from the coating solution, and to obtain a transfer member comprising the resin layer, and decorating a surface for decoration by pressing the transfer surface of the transfer member against the surface for decoration including a thermoplastic resin while heating.

Such a method for manufacturing can impart a uniform product appearance to a surface for decoration, based on a concavo-convex structure transferred to a transfer member. Thus, the method for manufacturing described above can provide a uniform product appearance easily even when forming a random concavo-convex structure such as non-glossy processing. In addition, in the method for manufacturing described above, only a part against which the transfer member is pressed while heating is decorated, thereby facilitating the partial decoration of the product. This manufacturing method eliminates the need to cover the other part of the product while decorating the part for decoration. Therefore, the method for manufacturing described above is a method for manufacturing with an improved operating efficiency.

In one embodiment, the concavo-convex surface described above may be a non-glossy surface.

In one embodiment, the concavo-convex surface and the surface for decoration described above may be on the same member. In such an embodiment, based on the concavo-convex surface formed on a part of the member, an appearance similar to the concavo-convex surface can be imparted to the other part of the member.

In one embodiment, a specular gloss of the surface for decoration that is decorated during the step of decorating may be within ±20% of a specular gloss of the concavo-convex surface. In the method for manufacturing described above, an appearance that sufficiently matches the appearance of the concavo-convex surface can be imparted to the surface for decoration, and such a matching of the appearance can be further enhanced by the specular gloss within the range described above.

Another aspect of the present invention relates to a method for repairing a part of the decorated surface in a decorative object including the decorated surface including a thermoplastic resin.

In one embodiment, a method for repairing a decorative object may include the steps of preparing a transfer member having a transfer surface, to which a concavo-convex structure formed by a decorative treatment is transferred, polishing a part of the decorated surface to form a surface for repair, and decorating the surface for repair by pressing the transfer surface of the transfer member against a region including the surface for repair while heating.

Such a method for repairing can impart an appearance to a surface for repair similar to the appearance obtained by the decorative treatment, thus matching the appearance of the repaired part and the appearance of the part surrounding the repaired part. In addition, the method for repairing described above can make the interface between the repaired part and the part surrounding the repaired part unnoticeable, thus providing a uniform product appearance as a whole.

In one embodiment, a specular gloss of the surface for repair that is decorated during the step of decorating may be within ±20% of a specular gloss of the other part of the decorated surface. In the method for repairing described above, an appearance that sufficiently matches the appearance of the part surrounding the repaired part can be imparted to the repaired part, and such a matching of the appearance can be further enhanced by the specular gloss within the range described above.

In one embodiment, a method for repairing described above may further include the steps of coating a concavo-convex surface to which the concavo-convex structure is formed by a decorative treatment with a coating solution including a resin component, and transferring by forming a resin layer having the transfer surface from the coating solution to obtain a transfer member comprising the resin layer.

In one embodiment, a specular gloss of the concavo-convex surface may be within ±20% of a specular gloss of the other part of the decorated surface. In the method for repairing described above, an appearance that sufficiently matches the appearance of the concavo-convex surface can be imparted to the repaired part. The specular gloss of the concavo-convex surface within the range described above can impart the appearance that specifically matches the part surrounding the repaired part (the other part of the decorative member) to the repaired part, enhancing the effect described above.

In one embodiment, the decorative treatment may be a non-glossy treatment.

Another aspect of the present invention relates to a transfer member to decorate a surface for decoration including a thermoplastic resin.

In one embodiment, a transfer member may include a film substrate having flexibility, and a resin layer disposed on one face of the film substrate. The resin layer has a transfer surface to which a concavo-convex structure formed by a decorative treatment is transferred, and such a transfer surface is on a side of the resin layer opposite to the film substrate.

Such a transfer member is one aspect of a transfer member used in the method for manufacturing of the decorative member or in the method for repairing of the decorative member described above, and such a transfer member can easily provide a decorative product having a uniform product appearance.

In one embodiment, the decorative treatment described above may be a non-glossy treatment.

Another aspect of the present invention relates to a decorative kit comprising the transfer member described above and a pressing jig for pressing the transfer member against the surface for decoration while heating. Such a decorative kit can easily provide a decorative product having a uniform product appearance.

In one embodiment, the decorative kit may further include a polishing jig for polishing the surface for decoration.

Advantages of certain embodiments described herein include providing a method for manufacturing a decorative object, which enables manufacturing of a decorative object, on which a random concavo-convex structure is formed, such as non-glossy finish, with a uniform product appearance, while the operating efficiency is excellent. In addition, the present invention provides a method for repairing a decorative object, which can achieve a uniform appearance across a repaired part and an unrepaired part and an excellent product appearance while preventing the interface between a repaired part and an unrepaired part becoming noticeable. Furthermore, the present invention further provides a transfer member and a decorating kit, which can be used in the method for manufacturing and the method for repairing described above.

DETAILED DESCRIPTION

Figure 1:
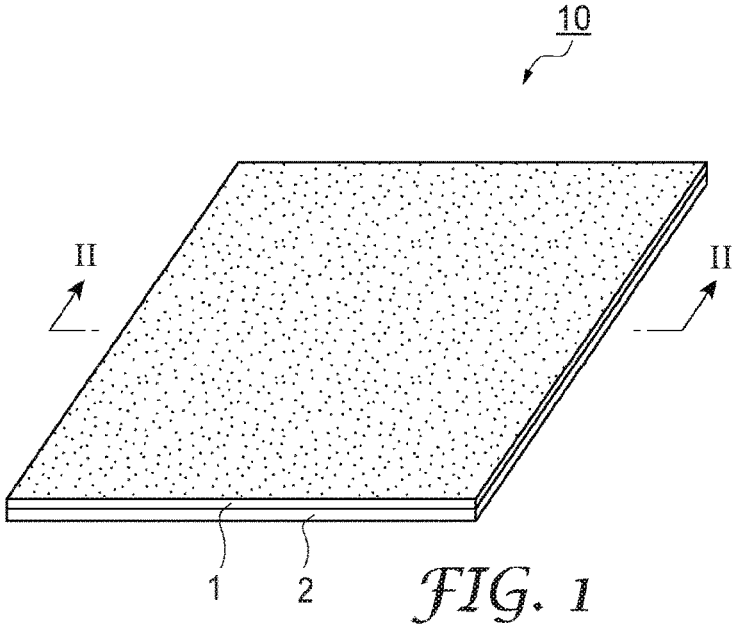
FIG. 1 is a perspective view of one embodiment of a transfer member according to the present invention.

Preferred embodiments according to the present invention will be explained in detail below, referencing the appended drawings. Note that in the various drawings, identical elements will be labeled with the same symbols and overlapping descriptions will be omitted. For easy understanding, a part of the drawings are illustrated with some magnification, but the sizes, proportions and the like are not limited to those illustrated in the drawings.

Transfer Member

Figure 2:
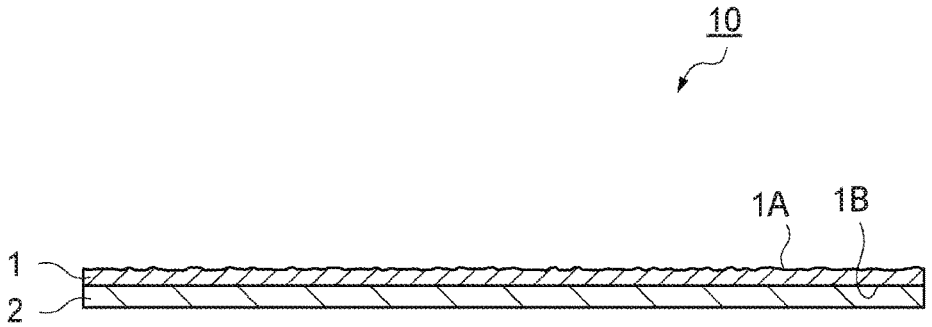
FIG. 2 is a sectional view along line II-II illustrated in FIG. 1.

FIG. 1 is a perspective view of one embodiment of a transfer member according to the present invention, and FIG. 2 is a sectional view along line II-II illustrated in FIG. 1. A transfer member 10 illustrated in FIGS. 1 and 2 is a member for decorating a surface for decoration including a thermoplastic resin, and includes a resin layer 1 having a transfer surface 1A and a film substrate 2 supporting the resin layer 1. A concavo-convex structure formed by a decorative treatment is transferred to the transfer surface 1A of the resin layer 1.

The transfer member 10 is arranged with the transfer surface 1A and the surface for decoration opposing each other, and is pressed from the side of the film substrate 2 while heating. Thus, the surface for decoration is decorated. The transfer surface 1A has a shape in which the concavo-convex structure formed by the decorative treatment is transferred (a shape that mates the concavo-convex structure). Thus, a concavo-convex structure, which is similar to the concavo-convex structure formed by the decorative treatment is formed on the surface for decoration.

The decorative treatment may be a non-glossy treatment. The concavo-convex structure formed by the decorative treatment may be a concavo-convex structure to provide a non-glossy surface, for example. The non-glossy treatment may be, for example, coating with a non-glossy paint or a mechanical treatment such as blast treatment.

The resin layer 1 may have heat resistance and mechanical strength enough to withstand heat and pressure. The conditions for heating and pressing may vary depending on materials that constitute the surface for decoration, therefore heat resistance and mechanical strength of the resin layer 1 may be adjusted as appropriate depending on the materials that constitute the surface for decoration.

The resin layer 1 may include a resin material and inorganic particles dispersed in the resin material, for example. For such a resin layer 1, the formation of the transfer surface 1A is easy. In addition, the heat resistance and mechanical strength of the resin layer can be easily controlled by controlling the composition.

A resin material as a main material that constitutes the resin layer 1 may not be limited as long as it can maintain the concavo-convex shape on the transfer surface 1A, while it can hold inorganic particles. The resin material may be a material that does not soften at the temperature experienced during pressing and heating (in other words, the resin material does not have a softening temperature lower than or equal to the temperature experienced during pressing and heating).

Examples of the resin material may include a cured material of a photocurable resin, a cured material of a thermosetting resin, a cured material of a two-part curable resin, a thermoplastic resin or the combination of these. The resin material may further include other ingredients such as an organic solvent, a lubricant, and dispersant.

Examples of the photocurable resin may include an acrylic resin, an epoxy resin, a urethane resin, and the like. Examples of the thermosetting resin may include an epoxy resin, a urethane resin, a phenol resin, and the like. Examples of the two-part curable resin may include a two-part curable epoxy resin, a two-part curable urethane resin, a two-part curable silicon resin, and the like. The thermoplastic resin may not be limited as long as the resin has the better heat resistance (higher softening temperature) than that of the thermoplastic resin in the decorative surface, and the examples include polyethylene, polypropylene, polyester, polyamide, and the like.

The inorganic particles may not be limited as long as they can be dispersed in the resin material and enhance the mechanical strength of the resin layer 1. Examples of the inorganic particles may include calcium carbonate powders, silica powders, aluminum oxide powders, silicon carbide powders, and the like.

The average size of the inorganic particles may be not less than 0.1 μm, for example, and preferably not less than 0.5 μm. The average particle size in this range can further improve the mechanical strength of the resin layer 1 and can help maintaining the concavo-convex shape of the transfer surface 1A. The average size of the inorganic particles may be not greater than 20 μm, for example, and preferably not greater than 10 μm. The average particle size in this range improves precision of the transfer of the concavo-convex structure on to the transfer surface 1A, making the more uniform product appearance achievable. The average particle size of the inorganic particles herein refers to a D50 value for volumetric particle size distribution measured according to JIS Z8825 (2013 Edition).

For example, a content of the inorganic particles may be not less than 50 parts by mass, or not less than 100 parts by mass per 100 parts by mass of the resin material. The content of the inorganic particles in this range can improve the mechanical strength of the resin layer 1 and can certainly prevent defects, breaking during decoration and the like, of the concavo-convex shape of the transfer surface 1A. For example, a content of the inorganic particles may be not greater than 400 parts by mass, or not greater than 350 parts by mass per 100 parts by mass of the resin material. The average particle size in this range improves precision of the transfer of the concavo-convex structure on the transfer surface 1A, making the more uniform product appearance achievable.

For example, the thickness of the resin layer 1 may be not greater than 200 μm, or not greater than 150 μm. For example, the thickness of the resin layer 1 may be not less than 5 μm, or not less than 10 μm.

The film substrate 2 may be disposed to support the resin layer 1 and to improve strength and handling of the transfer member 10. The film substrate 2 may be a film substrate having flexibility, for example. Such a film substrate can allow the transfer member 10 to follow a curved surface and facilitate decoration on the surface for decoration even when the surface is curved.

The film substrate 2 may have heat resistance enough to withstand heat and pressure applied to the surface for decoration. The conditions for heating and pressing may vary depending on the materials that constitute the surface for decoration, therefore heat resistance of the film substrate 2 may be adjusted as appropriate depending on the materials that constitute the surface for decoration.

The thickness of the film substrate 2 is not particularly limited, and, for example, may be not less than 10 μm or not less than 75 μm, and not greater than 300 μm or not greater than 150 μm.

The material of the film substrate 2 is not particularly limited, and, for example, may be a resin such as polyethylene terephthalate, polyethylene naphthalate, polyethylene, polypropylene, acrylic, polyimide, polyphenylene sulfide, or polycarbonate. Alternatively, the film substrate 2 may be a metal foil such as an aluminum foil.

The resin layer 1 and the film substrate 2 may be directly bonded together, or may be bonded via an adhesive and the like.

There is no particular limitation on the method for manufacturing of the transfer member 10. For example, a transfer member 10 may be manufactured by the method for manufacturing comprising the steps of coating with a coating solution including a resin component on a surface for decoration to which a decorative treatment is applied, and transferring the concavo-convex structure to a transfer surface to from a resin layer 1 having the transfer from the coating solution, and to obtain a transfer member 10 including the resin layer 1.

In the coating step, the resin component included in the coating solution may be a component that constitutes a resin material of the resin layer 1 by curing or solidification. The resin component may include, for example, a photocurable resin, a thermosetting resin, a two-part curable resin, a thermoplastic resin, and the like.

If the resin component includes a photocurable resin, the resin component may further include a photocuring agent. The photocuring agent may be selected according to the kind or the like of the photocurable resin as appropriate, and may be, for example, 2,4,6-trimethylbenzoyl diphenylphosphine oxide, bis(2,4,6-trimethylbenzoyl)phenylphosphine oxide, 2-methyl-1-(4-methylthiophenyl)-2-morpholinopropane-1-one, or the like.

If the resin component includes a thermosetting resin, the resin component may further include a heat curing agent. The heat curing agent may be selected according to the kind or the like of the thermosetting resin as appropriate.

The coating solution may further include inorganic particles. Such a coating solution can form a resin layer 1 including a resin material and inorganic particles.

The coating solution may further include an organic solvent. Preferably, the organic solvent can dissolve or disperse a component in the coating solution, and can be easily removed by drying and the like after coating. The kind of such an organic solvent is not particularly limited, and may be, for example, methyl ethyl ketone, isopropanol, propylene glycol monomethyl ether and the like.

The viscosity of the coating solution may be not less than 3 mPa·s, not less than 50 mPa·s or 80 mPa·s, for example.

The viscosity of the coating solution may be not greater than 3000 mPa·s, for example, and preferably not greater than 500 mPa·s and more preferably not greater than 300 mPa·s. The coating solution with a viscosity in the range above can fill cavities of the concavo-convex structure sufficiently and can improve the precision of the transfer of the concavo-convex structure. Note that the viscosity of the coating solution in the present disclosure is a value measured by a single cylinder-type rotational viscometer in accordance with JIS K7117-1 (1999 Edition).

In the transferring step, the resin layer 1 is formed from the coating solution. If the resin component in the coating solution includes a curable resin (a photocurable resin, a thermosetting resin, or a two-part curable resin), the transferring step may be a step, in which the resin component is cured to form the resin layer 1 that includes the cured product of the resin component. If the resin component in the coating solution includes a thermoplastic resin and an organic solvent, the transferring step may be a step, in which the organic solvent is removed to form the resin layer 1 that includes the thermoplastic resin.

In the transferring step, the film substrate 2 may be disposed on the resin layer 1. For example, the transfer member 10 may be formed by bonding the film substrate 2 on the surface of the resin layer 1 opposite to the transfer surface 1A, after the resin layer 1 is formed. Alternatively, the resin layer 1 may be formed in the state that the film substrate 2 is stacked, by stacking the film substrate 2 after the coating solution is coated, before the resin layer 1 is formed (for example before curing the resin component).

For example, if the resin component in the coating solution includes a photocurable resin, the resin layer 1 may be formed by stacking the film substrate 2 on a coating membrane consisting of the coating solution, then curing the resin component by photoirradiating the coating membrane through the film substrate 2. When performing such a transferring step, the film substrate 2 preferably has optical transparency.

The transfer member 10 manufactured by such a method for manufacturing can form a concavo-convex structure similar to the concavo-convex structure of the decorated surface used in the coating step, on the surface for decoration. The specular gloss of the surface for decoration decorated by the transfer member 10 may be within ±20%, ±10% or ±5% of the specular gloss of the decorated surface used in the coating step, for example.

Decorating Kit

Figure 3:
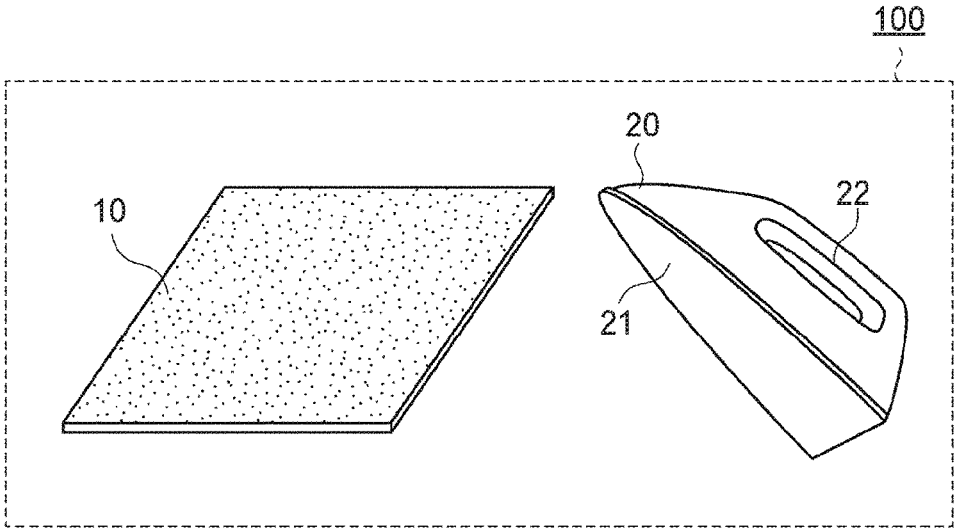
FIG. 3 is a schematic diagram illustrating one embodiment of a decorative kit according to the present invention.

FIG. 3 is a schematic diagram illustrating one embodiment of a decorative kit according to the present invention. A decorative kit 100 includes the transfer member 10 and a pressing jig 20 for pressing the transfer member 10 against the surface for decoration while heating. The pressing jig 20 includes a heating portion 21 for pressing the transfer member 10 from the substrate film 2 side while heating, and a grip portion 22 gripping the heating portion 21.

In FIG. 3, in the heating portion 21 of the pressing jig 20, the surface contacting to the transfer member 10 is planer, but the surface contacting the transfer member 10 is not limited to this shape. For example, the heating portion 21 may be curved, roll-shaped, hemispherical, or spherical.

The heating method for heating the heating portion 21 is not particularly limited, and may be, for example, electrically heated wire heating, ultrasonic heating, infrared heating, chemical reaction heating, warm water or oil bath heating or the like.

In FIG. 3, the pressing jig 20 includes the heating portion 21 and the grip portion 22, but the pressing jig 20 may not include the grip portion 22, or may include other supporting member instead of the grip portion 22, according to the pressing method for pressing the transfer member 10. The pressing method for pressing the transfer member 10 is not particularly limited, and may be, for example, pressurized air pressing using an air compressor and the like, vacuum pressing using a vacuum pump and the like, mechanical pressing using oil hydraulic pressure, a spring, and the like, weight pressing using a weight or the like.

The decorating kit 100 may further include a polishing jig for polishing the surface for decoration, for example, in addition to the transfer member 10 and the pressing jig 20. The polishing jig may be selected according to the embodiment of the surface for decoration, which is the object of polishing, as appropriate. Polishing the surface for decoration using the polishing jig produces a flat surface for decoration, thus enabling the uniform decoration. The polishing jig may be, for example, a sandpaper, an abrasive film, a polisher for an electric sander or the like.

Method for Manufacturing for Decorative Object

According to one embodiment, a method for manufacturing a decorative object includes the step of decorating a surface for decoration by pressing the transfer surface of the transfer member against the surface for decoration including a thermoplastic resin while heating.

According to one embodiment, a method for manufacturing a decorative object may further include steps of coating a concavo-convex surface having a concavo-convex structure with a coating solution including a resin component; and transferring the concavo-convex structure to a transfer surface to form a resin layer having the transfer surface, to obtain a transfer member comprising the resin layer.

The suitable embodiment of the transfer member includes the transfer member 10 described above. The suitable embodiment of the steps of coating and transferring includes the steps of coating and transferring in the method for manufacturing the transfer member described above.

During the step of decorating, the transfer member is arranged with the transfer surface and the surface for decoration opposing each other and the transfer member is pressed from the opposite side of the transfer surface while heating, for example. Thus, the thermoplastic resin of the surface for decoration becomes soft to induce the deformation of the surface for decoration to follow the concavo-convex shape of the transfer surface of the transfer member. The appearance similar to the concavo-convex surface is imparted to the surface for decoration. The concavo-convex surface may be a non-glossy surface, for example, and the decoration applied to the surface for decoration may be non-glossy. The specular gloss of the surface for decoration after the step of decorating may be within ±20%, ±10% or ±5% of the specular gloss of the concavo-convex surface, for example.

The methods of heating and pressing are not particularly limited, and may be heating and pressing using the pressing jig described above, for example. In the heating and pressing, the temperature of heating may be a temperature at which the thermoplastic resin of the surface for decoration sufficiently becomes soft. For example, if the surface for decoration is a coating surface of an automobile and the softening point of the resin included in the coating surface is approximately 60° C., the heating temperature may be from 50 to 300° C. or from 80 to 200° C. Also, the magnitude of pressing in the heating and pressing may be the pressure at which the surface for decoration can be sufficiently decorated. For example, if the surface for decoration is a coating surface of an automobile, the pressing pressure may be not lower than 10 $N/cm^2$ or not higher than 1 $kN/cm^2$.

The method for manufacturing described above can impart a uniform product appearance to a surface for decoration, based on a concavo-convex structure transferred to a transfer member. Thus, the method for manufacturing described above can provide a uniform product appearance easily even when forming a random concavo-convex structure such as non-glossy processing. In addition, in the method for manufacturing described above, only a part against which the transfer member is pressed while heating is decorated, thereby facilitating the partial decoration of the product. This manufacturing method eliminates the need to cover the other part of the product while decorating the part for decoration. Therefore, the method for manufacturing described above is a method for manufacturing with an improved operating efficiency.

In one embodiment, the concavo-convex surface for obtaining the transfer member and the surface for decoration may be on the same member. In such an embodiment, based on the concavo-convex surface formed on a part of the member, an appearance similar to the concavo-convex surface can be imparted to the other part of the member.

The decorative object decorated during the step of decorating may be an object having a surface for decoration to which the step of decorating can be performed. The decorative object may be, for example, an automobile, a home electrical appliance, a cell phone, a game console, an industrial product such as an architectural part, or the part thereof. Even if the decorative object is mainly constituted of a metallic material, the step of decorating described above can be performed for a coating surface formed on the surface of the decorative object as a surface for decoration, for example.

Method for Repairing for Decorative Object

A method for repairing a decorative object according to the present embodiment is a method for repairing a part of a decorated surface in a decorative object comprising the decorated surface including a thermoplastic resin. The method for repairing according to the present embodiment may be a method for repairing a scratch or a coating defect (e.g. contamination in a coating) of the decorated surface. The decorated surface may be a surface to which convexities and concavities are formed by a decorative treatment and may be a non-glossy surface, for example. The decorative treatment may be, for example, coating with a non-glossy paint or a mechanical treatment such as blast treatment.

A method for repairing according to the present embodiment may include the steps of preparing a transfer member having a transfer surface, to which a concavo-convex structure formed by a decorative treatment is transferred, polishing a part (part for repair) of the decorated surface to form a surface for repair, and decorating the surface for repair by pressing the transfer surface of the transfer member against a region including the surface for repair while heating.

A method for repairing according to the present embodiment may further include the steps of coating a concavo-convex surface to which the concavo-convex structure is formed by a decorative treatment with a coating solution including a resin component, and transferring by forming a resin layer having the transfer surface from the coating solution to obtain a transfer member comprising the resin layer.

The suitable embodiment of the transfer member includes the transfer member 10 described above. The suitable embodiment of the steps of coating and transferring includes the steps of coating and transferring in the method for manufacturing the transfer member described above.

A concavo-convex structure formed by a decorative treatment is transferred to the transfer surface of the transfer member. The decorative treatment may be a treatment that can impart an appearance similar to the decorated surface of the decorative object. For example, the decorative treatment is preferably a treatment by which a concavo-convex surface having a specular gloss of ±20% (more preferably ±10%, even more preferably ±5%) relative to the specular gloss of the other part (non-repair part) of the decorated surface can be formed. Namely, the transfer surface of the transfer member may preferably be a surface to which a concavo-convex structure of a concavo-convex surface having a specular gloss of ±20% (more preferably ±10%, even more preferably ±5%) relative to the specular gloss of the non-repair part of the decorated surface has been transferred. Thus, an appearance that superbly matches the appearance of the part surrounding the repaired part (the part other than the repaired part) can be imparted to the repaired part.

For example, the transferred surface of the transfer member may be the surface to which a concavo-convex structure is transferred from the concavo-convex surface applied to the decorative treatment same as or similar to the decorative treatment applied to the decorated surface of the decorative object. Alternatively, the transferred surface of the transfer member may be the surface to which a concavo-convex structure is transferred from the non-repaired part of the decorative surface.

The step of polishing is a step to polish a part (repair part) of the decorative surface. During the step of polishing, for example, a contamination and the like included during coating can be removed and the flat surface for repair can be formed. The method of polishing during the step of polishing can be selected according to the shape of the decorative object, the shape of the decorated surface and the like, as appropriate. For example, the method of polishing may be polishing by a sandpaper, polishing by an abrasive film, compounding, polishing by a single or an orbital sander tool, and the like.

The step of decorating is a step of pressing the transfer surface of the transfer member against a region including the surface for repair while heating. In the step of decorating, decoration based on the transfer surface of the transfer member is applied to a region including the surface for repair. The region against which the transfer member is pressed while heating may include at least the surface for repair that has been polished during the step of polishing, and further include the part surrounding the surface for repair. In the present embodiment, even if the transfer member is pressed against the region including the part surrounding the surface for repair while heating, a uniform appearance can be imparted to both the surface for repair and the part surrounding the surface for repair.

In the conventional method for repairing, for example, if a paint for repair is applied to a part surrounding the repair part, there are cases where an appearance is compromised due to the convex protrusion by the overlap of the coatings. Therefore, precision in the work is required for the repair process and it is difficult to make the interface between the repair part and the part surrounding the repair part unnoticeable in the conventional method for repairing. However, in the present embodiment, because a concavo-convex structure which exhibits an appearance substantially identical to the original concavo-convex surface can be easily formed, if the treatment is applied to the surface for repair and the region surrounding the surface for repair, a uniform appearance can be imparted to the regions. And the interface between the region and the part surrounding the region is not noticeable. Precision in the work is not required.

The method for pressing and heating is not particularly limited. As the method for pressing and heating, the method for pressing and heating in the method for manufacturing a decorative object described above may be exemplified.

The decorative object repaired by the method for repair according to the present embodiment may be an object having a surface for decoration to which the step of polishing and the step of decorating described above can be performed. The decorative object may be, for example, an automobile, a home electrical appliance, a cell phone, a game console, an industrial product such as an architectural part, or the part thereof. Even if the decorative object is mainly constituted of a metallic material, the step of polishing and the step of decorating can be performed for a coating layer formed on the surface of the decorative object as a surface for decoration, for example.

Verification Test (1) Preparation of a Test Piece Having a Non-Glossy Surface

A test piece was prepared by coating a top-coat solution with the ingredients listed in Table 1 below being blended on a steel plate (thickness: 1 mm). The test piece included a top coat layer having a non-glossy surface.

TABLE 1

| | Trade Name | Compounded amount |
|---|---|---|
| Non-glossy paint | Silica Top | 67 mass % |
| Curing Agent | H9000 | 18 mass % |
| Thinning agent | — | 15 mass % |

It should be noted that, in Table 1, the non-glossy paint was "Silica Top" (trade name, manufactured by BASF Japan Ltd., Minato-ku, Tokyo) and the curing agent was "H9000 Hardener" (trade name, manufactured by BASF Japan Ltd., Minato-ku, Tokyo).

(2) Preparation of Transfer Member

The coating solution with ingredients listed in Table 2 below being blended was coated on the non-glossy surface of the transfer member, to form a coating membrane. This was followed by laminating a polyester film (thickness: 75 μm) on the coating membrane. Photoirradiation was performed from above the polyester film using a chemical lamp (peak at 352 nm wavelength) for 20 minutes to form a resin layer including the cured product of the coating membrane. Then, a transfer member including the polyester film and the resin layer was obtained by pealing it off from the test piece.

TABLE 2

| | Trade Name | Compounded amount |
|---|---|---|
| Acrylic resin A | SR351 | 20 mass % |
| Acrylic resin B | SR339 | 13 mass % |
| Dispersant | Solplus D520 | 1 mass % |
| Silane coupling agent | KBM-503 | 2 mass % |
| Photocuring agent | Lucirin TPO-L | 1 mass % |
| Fumed silica | OX-50 | 3 mass % |
| Alumina powder | GC3000 Mineral | 59 mass % |

It should be noted that, in Table 2, the acrylic resin A was "SR351" (trade name, manufactured by Sartomer, Pa., U.S.A.), the acrylic resin B was "SR339" (trade name, manufactured by Sartomer, Pa., U.S.A.), the dispersant was "Solplus D520" (trade name, manufactured by Lubrizol Corp., OH, U.S.A.), the silane coupling agent was "KBM-503" (trade name, manufactured by Shin-Etsu Chemical Co., Ltd., Chiyoda-ku, Tokyo), the photocuring agent was "Lucirin TPO-L" (trade name, manufactured by BASF Japan Ltd., Minato-ku, Tokyo), the fumed silica was "OX-50" (trade name, manufactured by Nippon Aerosil Co., Ltd., Shinjuku-ku, Tokyo) and the alumina powder was "GC3000 Mineral" (trade name, manufactured by Fujimi Incorporated, Kiyosu-shi, Aichi).

(3) Decoration by Transfer Member

A flat surface for decoration was formed by polishing the part of the non-glossy surface of the test piece. The transfer member obtained in (2) was placed opposing the surface for decoration. Using a heat-press apparatus, pressing was performed on the transfer member from the side of polyethylene film under the conditions of 150° C., 0.8 kN/cm$^2$ for 10 minutes, thereby decorating the surface for decoration.

Figure 4A:
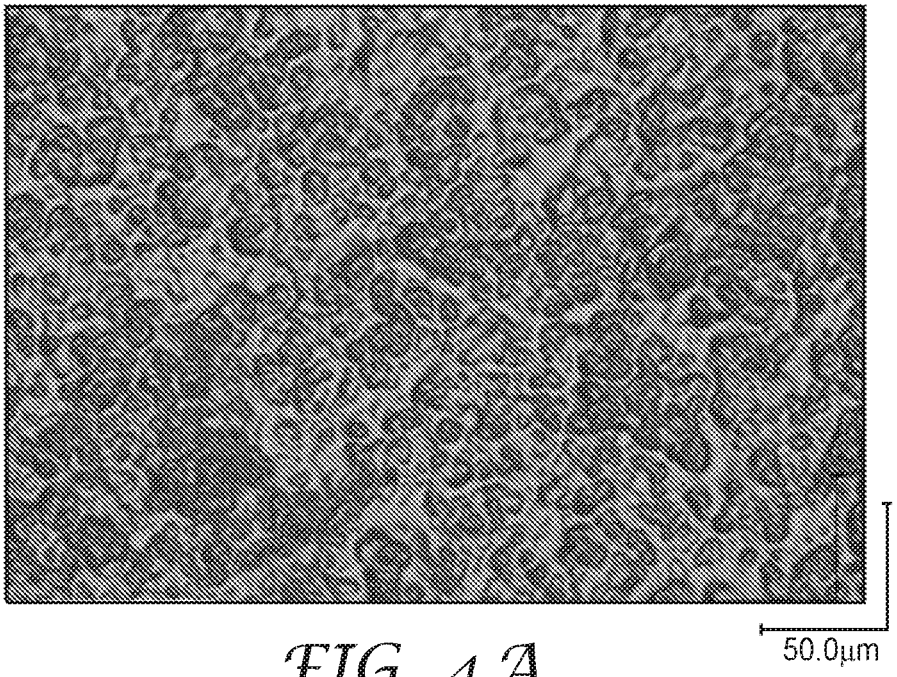
FIG. 4A is a microscope image of the decorative surface used in Verification Test.
Figure 4B:
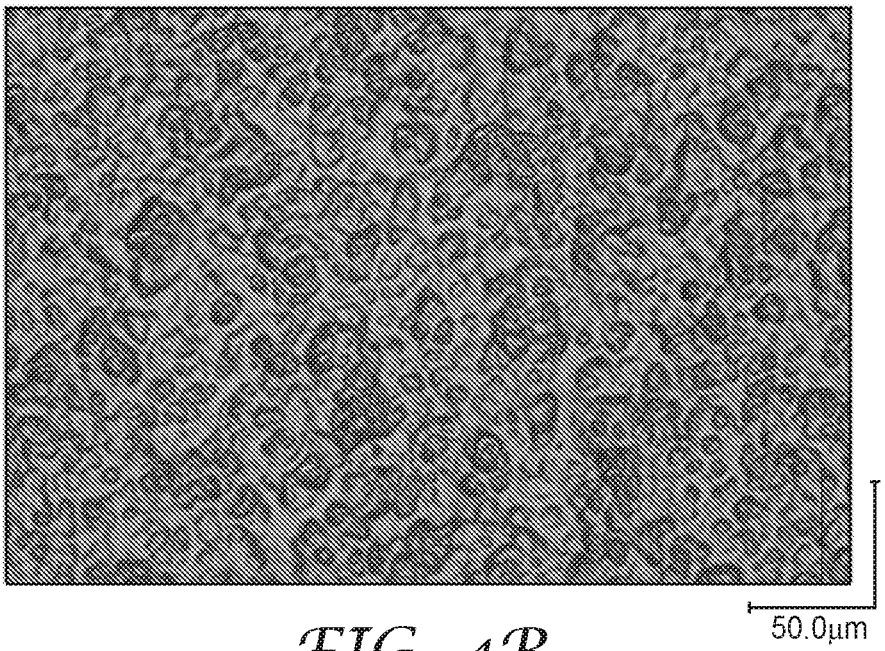
FIG. 4B is a microscope image of the non-glossy surface used in Verification Test.

The specular gloss of the decorated surface obtained was measured using Micro Gloss Meter (BYK Gardner 75°) in accordance with JIS Z8741 (1997 Edition). The specular gloss was 220. It should be noted that the specular gloss of the non-glossy surface prior to polishing was 202. From the results of the Verification Test, it was verified that the decorated surface that exhibited the similar appearance of the non-glossy surface used for the preparation of the transfer member was easily obtained by decoration using the transfer member. Also the interface between the decorated surface and the part surrounding the decorated surface was unnoticeable, and the uniform product appearance similar to the appearance prior to polishing was obtained. FIG. 4A is a microscope image of the decorative surface used in the Verification Test. FIG. 4B is a microscope image of the non-glossy surface used in the Verification Test.

In the above, the preferred embodiments of the present invention were explained, but the present invention is not limited to these embodiments. For example, though the method for repairing the decorated object was described as one embodiment of the present invention, the method for repairing the decorated object may be referred to as a method for manufacturing a repaired decorated object.

REFERENCE NUMERAL LIST

1 Resin layer
2 Film substrate
10 Transfer member
20 Pressing jig
21 Heating portion
22 Grip portion
100 Decorating kit

The invention claimed is:

1. A method for repairing a coating defect in a part of a decorated surface in a decorative object comprising the decorated surface, wherein the decorated surface comprises a thermoplastic resin comprising a concavo-convex surface, the method comprising the steps of:

preparing a transfer member having a transfer surface comprising a concavo-convex structure that exhibits an appearance substantially identical to the concavo-convex surface of the decorative object;

polishing a part of the decorated surface comprising the coating defect to form a surface for repair that is a flat surface; and decorating the surface for repair by pressing the transfer surface of the transfer member against a region including the surface for repair while heating to impart the concavo-convex structure of the transfer surface to the region including the surface for repair, such that the surface for repair exhibits an appearance substantially identical to the concavo-convex surface of the decorated surface outside of the region.

2. The method according to claim 1, wherein a specular gloss of the surface for repair that is decorated during the step of decorating is within ±20% of a specular gloss of the other part of the decorated surface.

3. The method according to claim 1 wherein preparing the transfer member further comprises the steps of:

coating a concavo-convex surface having with a coating solution including a resin component to form a resin layer comprising the concavo-convex structure; and removing the resin layer from the concavo-convex surface to provide the transfer member.

4. The method according to claim 3, wherein a specular gloss of the concavo-convex surface is within ±20% of a specular gloss of the other part of the decorated surface.

* * * * *